US007148857B2

(12) United States Patent
Lin et al.

(10) Patent No.: US 7,148,857 B2
(45) Date of Patent: Dec. 12, 2006

(54) ANTENNA ASSEMBLY

(75) Inventors: Hsien-Chu Lin, Tu-chen (TW); Mu-Hsiung Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,544

(22) Filed: Dec. 28, 2004

(65) Prior Publication Data

US 2005/0200558 A1 Sep. 15, 2005

(30) Foreign Application Priority Data

Mar. 12, 2004 (TW) ..... 93203797 U

(51) Int. Cl.
*H01Q 1/52* (2006.01)

(52) U.S. Cl. ..... 343/841; 343/904

(58) Field of Classification Search ..... 343/702, 343/841, 906

See application file for complete search history.

(56) References Cited

U.S. PATENT DOCUMENTS

| | | | | |
|---|---|---|---|---|
| 4,672,337 | A * | 6/1987 | Thibeault | 333/167 |
| 5,630,223 | A * | 5/1997 | Bahu et al. | 455/296 |
| 6,229,493 | B1 * | 5/2001 | Iijima | 343/713 |
| 6,975,274 | B1 * | 12/2005 | Sanchez et al. | 343/702 |
| 2003/0079234 | A1 * | 4/2003 | Rasmussen | 725/153 |

* cited by examiner

*Primary Examiner*—Tho Phan
(74) *Attorney, Agent, or Firm*—Wei Te Chung

(57) ABSTRACT

An antenna assembly according to the present invention includes an antenna, a protecting device and cables. A radio frequency module is set before the antenna assembly and supplies signal power to the antenna through cables. The protecting device is located between the antenna and the radio frequency module so as to avoid undesired direct current to flow into the radio frequency module. The antenna, protecting device and radio frequency module are connected by cables. Connecting with and protected by the protecting device, the RF module works reliably under the above-mentioned construction of the antenna assembly which can hardly affect the performance of the antenna.

15 Claims, 7 Drawing Sheets

ANTENNA ASSEMBLY

BACKGROUND OF THE INVENTION

1. Field of the Invention

The present invention relates generally to an antenna assembly, and more particularly to an antenna assembly for wireless communication.

2. Description of the Prior Art

With the development of wireless communication, antenna transmitting and receiving signals plays an important role in wireless communication process. The performance of the antenna affects the quality of signal transmission and reception. Consequently researchers in this field focus much their attention on the design or improvement of antenna. In fact, radio frequency module (modulating, filtering, amplifying demodulating signals and so on) is no less important than the antenna for realizing excellent wireless communication. High quality signal transmission and reception needs them to work in concert.

Antenna and radio frequency module are coupled by transmission line, they are coupled directly by the transmission line. For example, both U.S. patent application Ser. No. 090,112,176 and U.S. patent application Ser. No. 91,100,053 disclose a common antenna assembly, just using a transmission line to connect an antenna with a radio frequency module. It is well known that there are many active devices in the RF module, such as amplifier, filter, modulator, demodulator and so on, which are all powered by direct current. During working, these active devices work at a certain state direct current working point. The performances of these active devices depend much on the direct current, and therefore undesired direct current if exits would highly affects the performance of the wireless system. In most cases, antenna is set in the open air. As the environment is complex, static current often arise from the antenna, and it can go through the transmission line into the RF module in former wireless systems. As a result, direct current distortion arises.

BRIEF SUMMARY OF THE INVENTION

It is an object of the present invention to provide an antenna assembly for restraining undesired direct current.

To achieve the aforementioned object, the present invention provides an antenna assembly which comprises an antenna, a protecting device and cables. A radio frequency module is set before the antenna assembly and supplies signal power to the antenna through cables. The protecting device is located between the antenna and the radio frequency module so as to avoid undesired direct current to flow into the radio frequency module. The antenna, protecting device and radio frequency module are connected by cables. Connecting with and protected by the protecting device, the RF module works reliably under the above-mentioned construction of the antenna assembly which can hardly affect the performance of the antenna.

Additional novel features and advantages of the present invention will become apparent by reference to the following detailed description when taken in conjunction with the accompanying drawings.

DETAIL DESCRIPTION OF THE INVENTION

Reference will now be made in detail to a preferred embodiment of the present invention.

Figure 1:
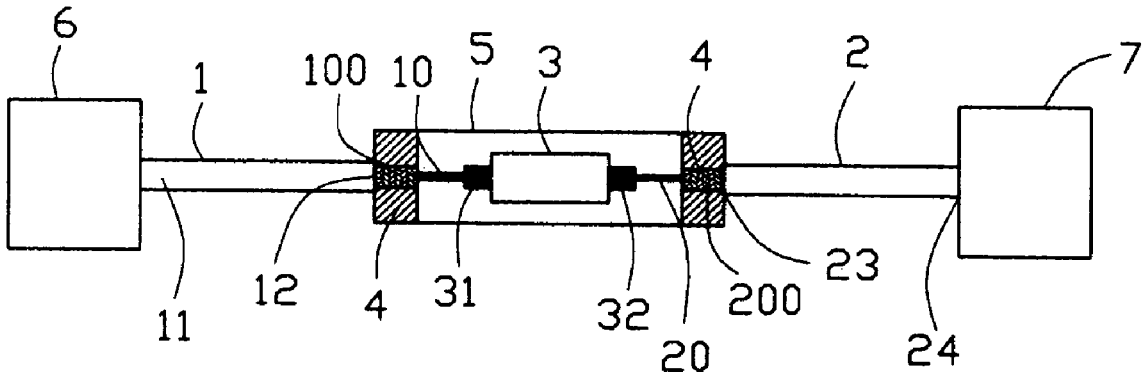
FIG. 1 is a schematic view of an antenna assembly according to the present invention.

Referring to FIG. 1, an antenna assembly of the present invention comprises an antenna 6, a protecting device, a first cable 1 and a second cable 2. A signal feeding to the antenna 6 is transmitted from radio frequency module 7 by the cables 1, 2. A capacitor 3 and a printed circuit board carrying the capacitor 3 constitute the protecting device, which is linked to the antenna 6 by the cable 1 and linked to radio frequency module by the cable 2. A metal served as a ground portion 4 is foiled on the printed circuit board. The capacitor 3 has two pins 31, 32, which are welded to printed circuit board by through-hole or surface mount technology. An inner conductor 10 of the first cable 1 connects with a first pin 31 of the capacitor 3 and an outer conductor 100 of the first cable 1 connects with the ground portion 4 of the printed circuit board. An inner conductor 20 of the second cable 2 connects with the second pin 32 of the capacitor 3 and an outer conductor 200 of the second cable 2 connects with the ground portion 4 of the printed circuit board.

The selection of the value of the capacitor 21 is concerned. Capacitors come in a wide range of values, but what value can be chose here is very important. If the value of the capacitor is too large, the radiation performance of the antenna will be adversely affected. If the value of the capacitor is too small, the protection for radio frequency module will be weakened. In this embodiment of the present invention, the value is 47 picoFarads when the antenna operates at frequencies for 80211a or 802.11b. In addition, the protecting device can't be located adjacent to the antenna 6.

Figure 2:
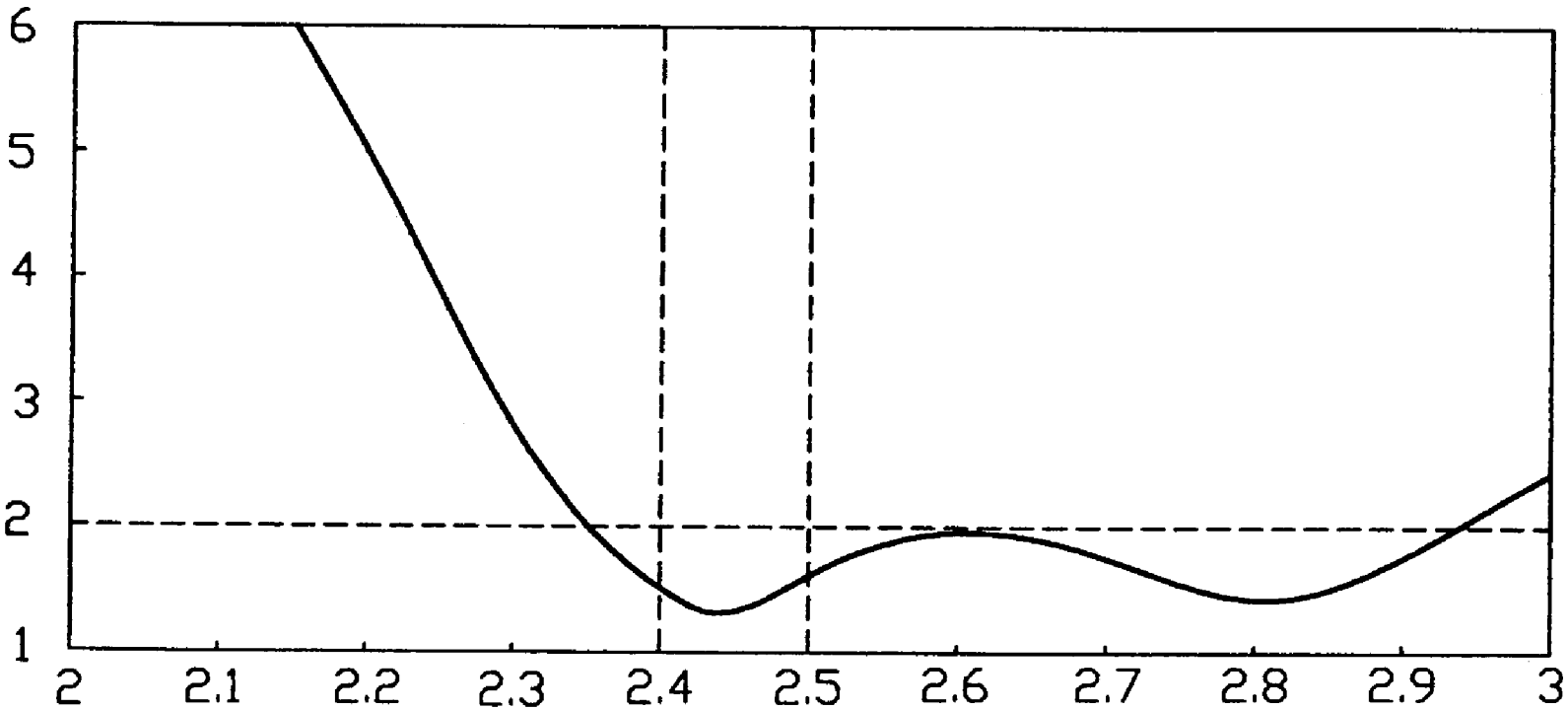
FIG. 2 is a test chart recording for an antenna assembly of FIG. 1 without a protecting device, showing Voltage Standing Wave Ratio (WSVR) as a function of frequency.
Figure 5:
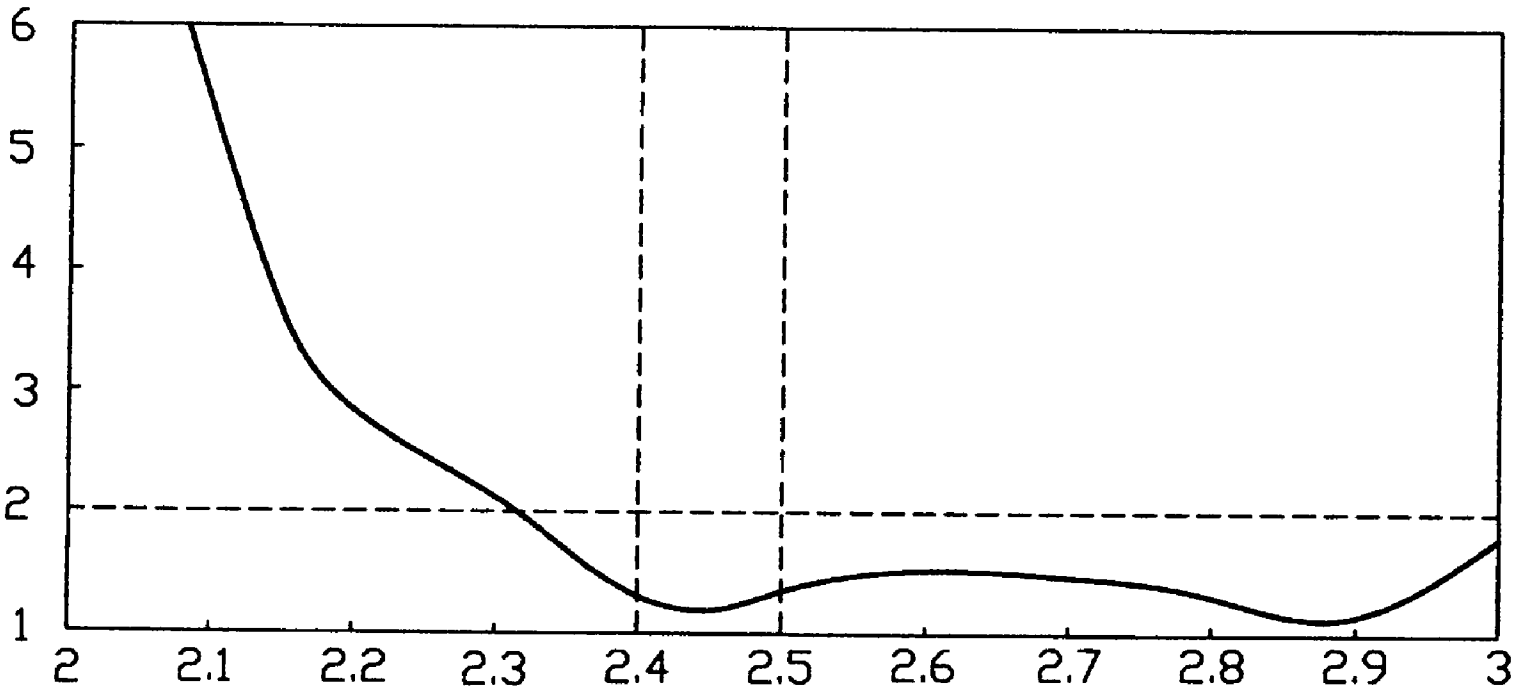
FIG. 5 is a test chart recording for an antenna assembly of FIG. 1, showing Voltage Standing Wave Ratio (WSVR) as a function of frequency.

Referring to FIG. 2, it's a test chart of Voltage Standing Wave Ratio (VSWR) recording for an antenna assembly without the protecting device, and referring to FIG. 5, it's a test chart of (VSWR) recording for the antenna assembly with the protecting device. Under the definition of VSWR less than 2, the effective bandwidth of FIG. 2 and that of FIG. 3 covers 2.35–2.95 GHz and 2.33–3.0 GHz, respectively, so it is easy to find that the bandwidth of the antenna can hardly be effected by the protecting device.

Figure 3:
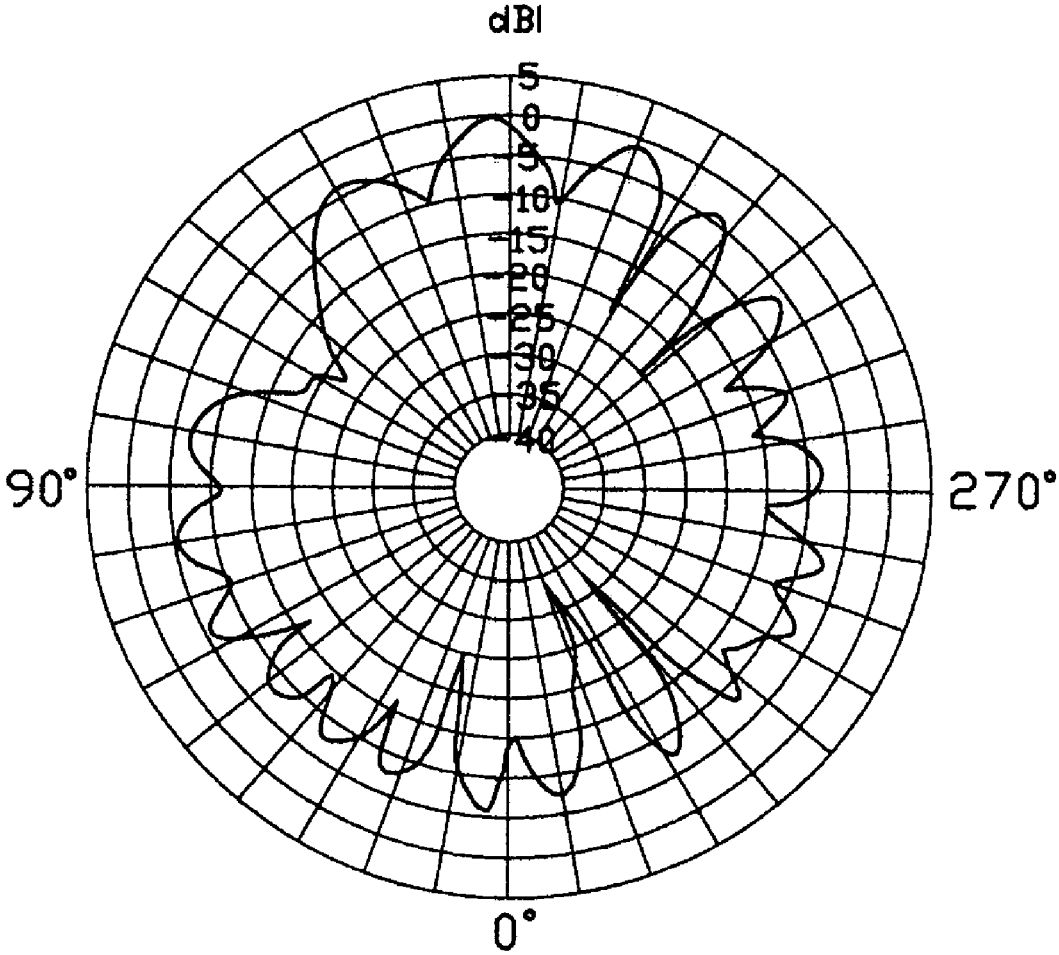
FIG. 3 is a horizontally polarized principle plane radiation pattern (where the principle plane is an X-Y plane) of an antenna assembly of FIG. 1 without a protecting device at a frequency of 2.45 GHz.
Figure 4:
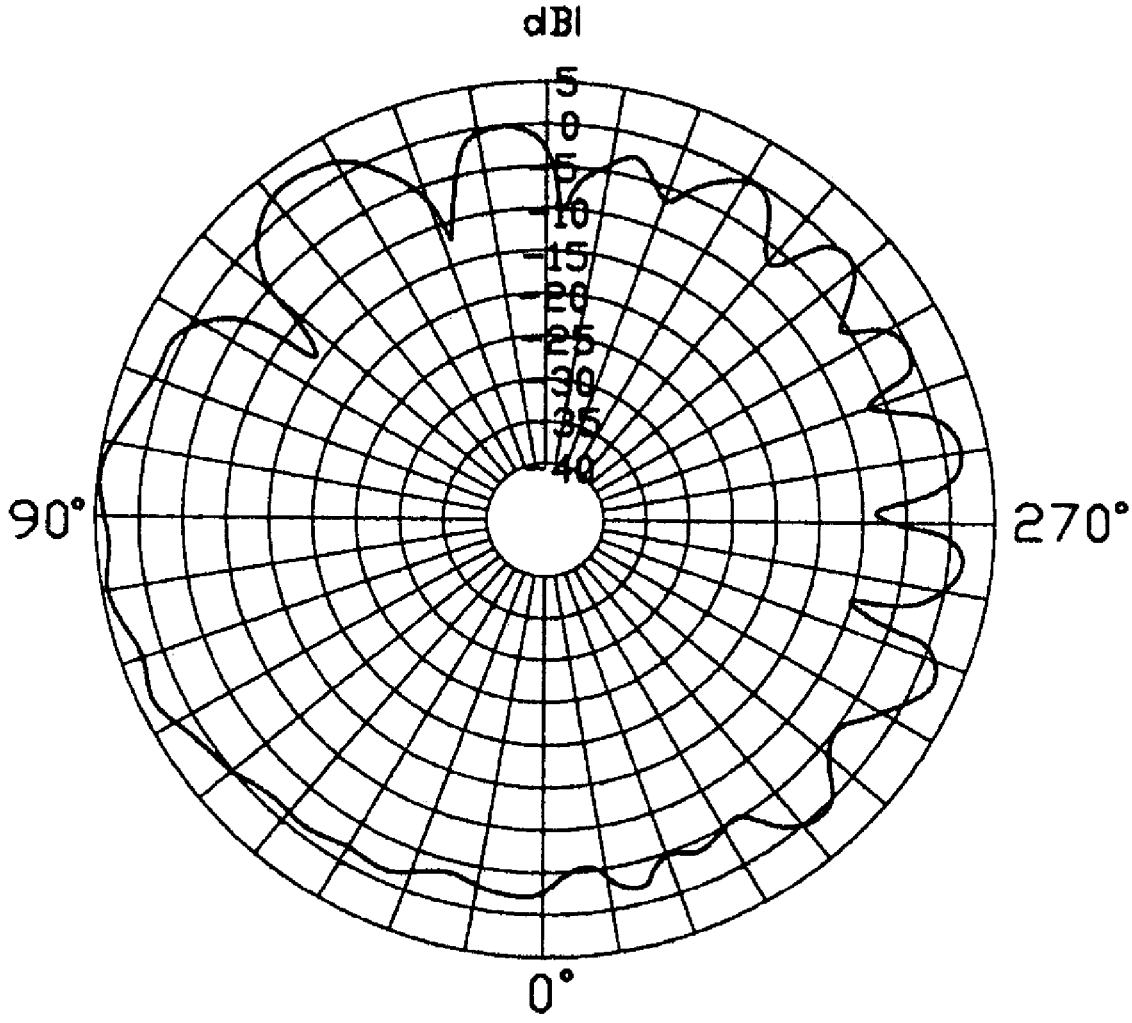
FIG. 4 is a vertically polarized principle plane radiation pattern (where the principle plane is an X-Y plane) of an antenna assembly of FIG. 1 without a protecting device at a frequency of 2.45 GHz.
Figure 6:
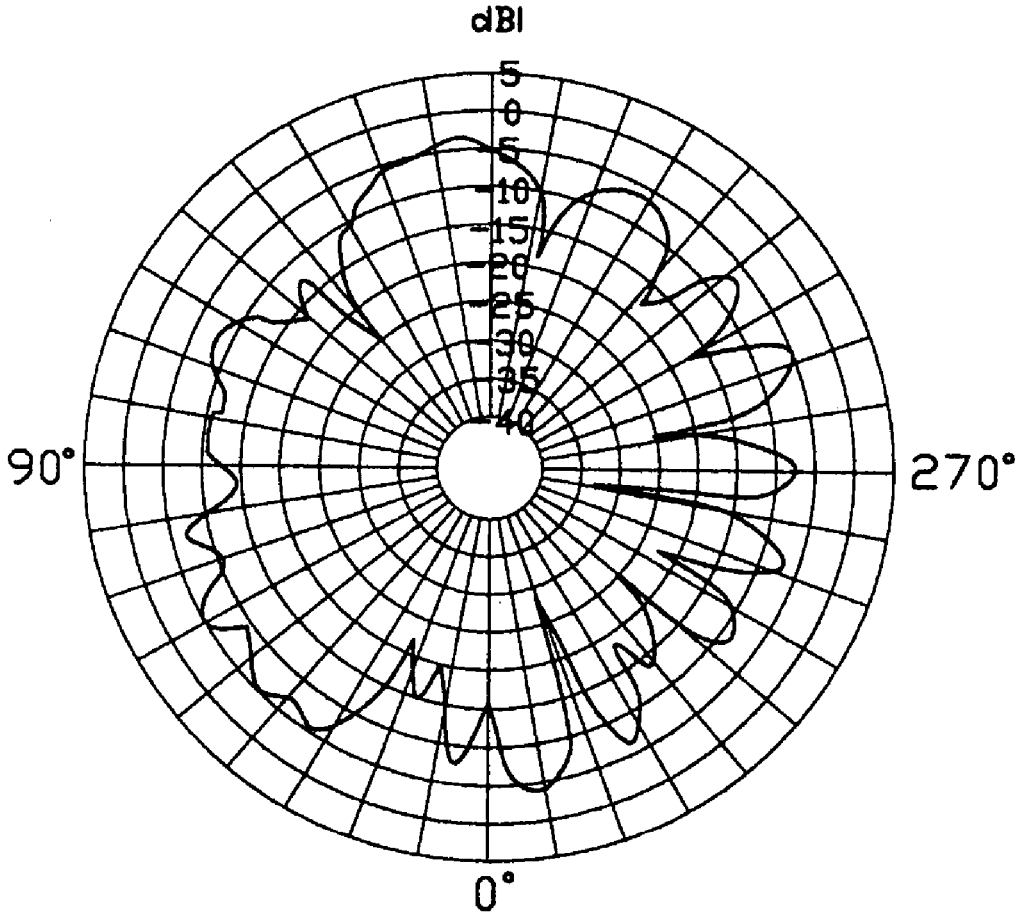
FIG. 6 is a horizontally polarized principle plane radiation pattern (where the principle plane is an X-Y plane) of an antenna assembly of FIG. 1 at a frequency of 2.45 GHz.
Figure 7:
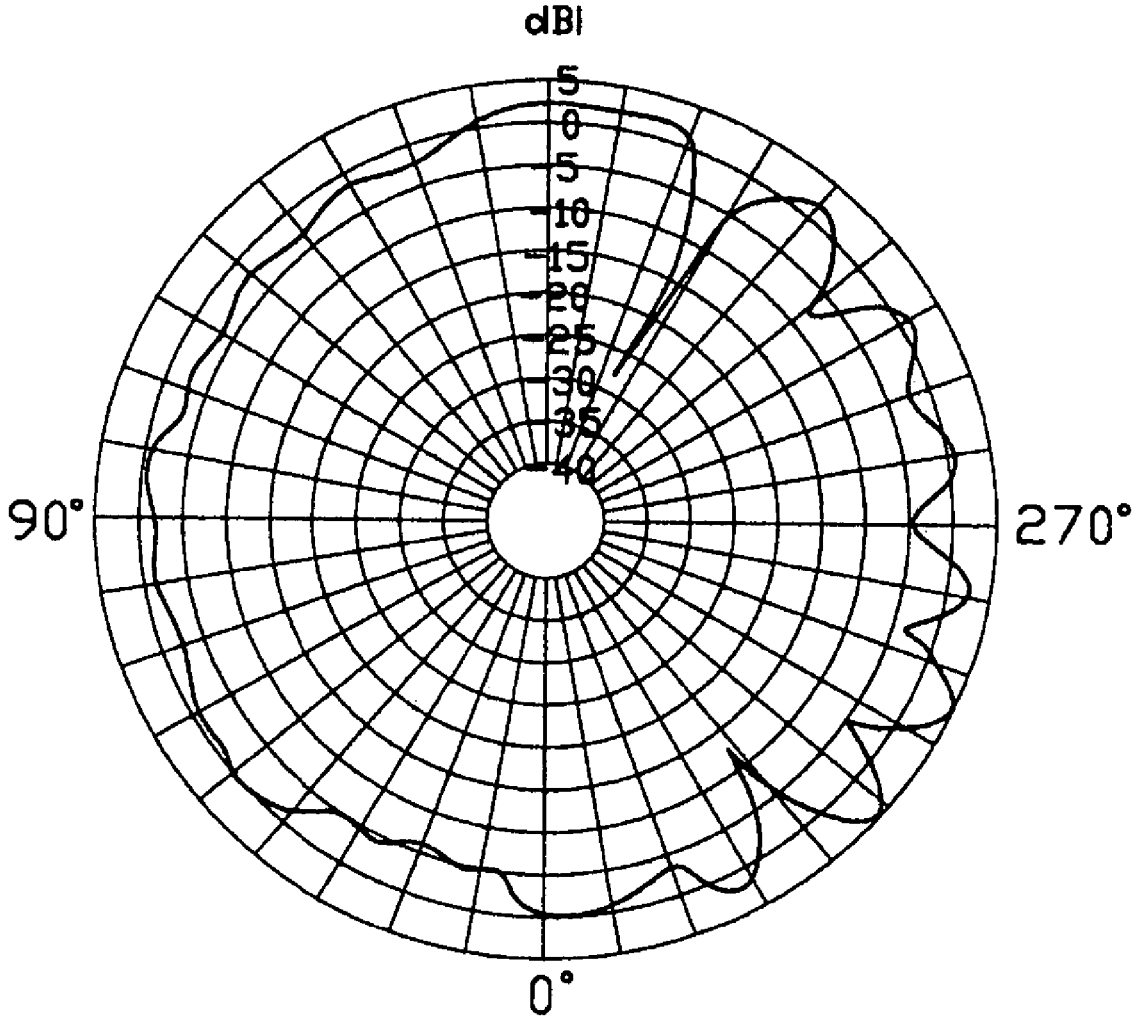
FIG. 7 is a vertically polarized principle plane radiation pattern (where the principle plane is an X-Y plane) of an antenna assembly of FIG. 1 at a frequency of 2.45 GHz.

FIG. 3 shows a horizontally polarized principle radiation pattern of the antenna assembly without the protecting device operating at a frequency of 2.45 Ghz and FIG. 6 also shows a horizontally polarized principle radiation pattern of the antenna assembly but with the protecting device operating at a frequency of 2.45 Ghz. With the comparison of the two Figs, the horizontally polarized principle radiation pattern at 2.45 GHz is mainly the same. Next referring to FIG. 4 and FIG. 7, the vertically polarized principle radiation pattern at 2.45 GHz is mainly the same regardless of the protecting device. Accordingly, setting a protecting device within an antenna assembly has no effect on the radiation pattern of the antenna.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An antenna assembly, comprising:

an antenna for receiving and transmitting signals;

a protecting device for reducing interferential signals; and a radio frequency module electrically connected to the antenna through said protecting device;

wherein the protecting device comprises a printed circuit board, a grounding portion and a capacitive component all positioned on said printed circuit board.

2. The antenna assembly as claimed in claim 1, further including a first cable coupled with and between said antenna and said protecting device, and a second cable coupled with and between said protecting device and said radio frequency module.

3. The antenna assembly as claimed in claim 2, wherein said first cable comprises an inner conductor interconnecting with said antenna and capacitive component and an outer conductor interconnecting with said antenna and said grounding portion of the protecting device.

4. The antenna assembly as claimed in claim 2, wherein said second cable also comprises an inner conductor interconnecting with said capacitive component and said radio frequency module and an outer conductor interconnecting with said grounding portion of the protecting device and said radio frequency module.

5. The antenna as claimed in claim 1, wherein suitable capacitance of said capacitive component is about 47 pico-Farads when said antenna operates at frequencies for 802.11a or 802.11b.

6. The antenna assembly as claimed in claim 1, wherein said capacitive component comprises at least a capacitor.

7. The antenna assembly as claimed in claim 6, wherein said capacitor having a first pin and a second pin, which are soldered to said printed circuit board by through-hole technology.

8. The antenna assembly as claimed in claim 6, wherein said capacitor is welded to said printed circuit board by surface mount technology.

9. The antenna assembly as claimed in claim 1, wherein said grounding portion is formed of conductive paths located on said printed circuit board.

10. The antenna assembly as claimed in claim 1, wherein said antenna can be any type of antenna.

11. The antenna assembly as claimed in claim 1, wherein said protecting device is located far away from said antenna.

12. An antenna assembly comprising:

an antenna for receiving and transmitting signals;

a protecting device for reducing interferential signals and electrically connected to the antenna;

a cable connecting said protecting device to a radio frequency module;

wherein the protecting device defines a ground portion connected to an outer conductor of the cable, and a filter device connected between an inner conductor of the cable and the antenna, wherein the filter device further comprises a printed circuit board, a capacitor positioned on the printed circuit board and having a pair of pins, the pair of pins are welded to the printed circuit board by through-hole or surface mount technology.

13. The antenna assembly as claimed in claim 12, wherein the filter device comprised a capacitor having a pair of pins, one of the pins connects to the inner conductor of the cable.

14. An antenna assembly comprising:

an antenna for receiving and transmitting signals;

a protecting device for reducing interferential signals;

a radio frequency module electrically connected to the protecting device; a cable connecting said protecting device to the antenna;

wherein the protecting device defines a ground portion connected to an outer conductor of the cable, and a filter device connected between an inner conductor of the cable and the radio frequency module, wherein the filter device further comprises a printed circuit board, a capacitor positioned on the printed circuit board and having a pair of pins, the pair of pins are welded to the printed circuit board by at least one of through-hole or surface mount technology.

15. The antenna assembly as claimed in claim 14, wherein the filter device comprises a capacitor having a pair of pins, one of the pins connects to the inner conductor of the cable.

* * * * *